US011485553B2

(12) United States Patent
Yoshida et al.

(10) Patent No.: US 11,485,553 B2
(45) Date of Patent: Nov. 1, 2022

(54) CONTAINER WITH CAP

(71) Applicant: YOSHIDA INDUSTRIES CO., LTD., Tokyo (JP)

(72) Inventors: Yuzo Yoshida, Tokyo (JP); Michiaki Kumagai, Tokyo (JP)

(73) Assignee: YOSHIDA INDUSTRIES CO., LTD., Tokyo (JP)

( * ) Notice: Subject to any disclaimer, the term of this patent is extended or adjusted under 35 U.S.C. 154(b) by 0 days.

(21) Appl. No.: 17/401,312

(22) Filed: Aug. 13, 2021

(65) Prior Publication Data

US 2022/0055806 A1 Feb. 24, 2022

(30) Foreign Application Priority Data

Aug. 24, 2020 (JP) ..... JP2020-140691

(51) Int. Cl.
*B65D 50/04* (2006.01)

(52) U.S. Cl.
CPC ..... *B65D 50/043* (2013.01)

(58) Field of Classification Search
CPC ..... B65D 50/043; B65D 41/0471; B65D 2251/0015; B65D 2215/02; B65D 51/18; B65D 79/0087
See application file for complete search history.

(56) References Cited

U.S. PATENT DOCUMENTS 3,288,115 A 11/1966 Hechtle
10,106,302 B1 * 10/2018 Sorby ..... B65D 49/02
2012/0248129 A1 * 10/2012 Yoshida ..... B65D 50/046 220/780
2018/0132592 A1 * 5/2018 Chung ..... A45D 33/025
2019/0002168 A1 * 1/2019 Ke ..... B65D 43/022

FOREIGN PATENT DOCUMENTS

JP 2019-501675 A 1/2019

OTHER PUBLICATIONS

"How Does a Clicky Pen Work?", YouTube video searched online Jul. 17, 2020 at www.youtube.com/watch?v=Zv5Qa2kGL04&feature=emb_title.
"The mystery of a knock-type ballpoint pen that moves in and out with the same movement", searched online Jul. 17, 2020 at monoist.atmarkit.co.jp/mn/articles/2003/16/news007.

* cited by examiner

*Primary Examiner* — Shawn M Braden
(74) *Attorney, Agent, or Firm* — Isshiki & Partners; Joseph P. Farrar, Esq.

(57) ABSTRACT

A container with cap provided with a knock cam mechanism having an uncomplicated structure employing a small number of parts, enabling the cap to be securely attached to and detached from the container body. The cap has a housing in which a plurality of grooves alternating with ribs are formed in an inner circumferential surface thereof at equiangular intervals around a cylindrical axis, and inside the housing are disposed a push-button plunger having protrusions formed on the outer peripheral surface that slide along inside the grooves, a ratchet having sloped protrusions on the outer circumference, an inner lid having tabs on the peripheral wall, an elastic member for urging the ratchet upward, and a container body in which a locking portion is formed on the outer circumference of a neck of the container body.

8 Claims, 8 Drawing Sheets

CONTAINER WITH CAP

CROSS-REFERENCE TO RELATED APPLICATIONS

This application claims priority pursuant to 35 U.S.C. § 119 from Japanese Patent Application No. 2020-140691, filed on Aug. 24, 2020, the content of which is incorporated herein by reference in its entirety.

BACKGROUND

Technical Field

The present disclosure relates to a container with cap.

Related Art

A container with cap, called a "jar container" or "bottle container", has a container body for storing contents and a cap for sealing the opening of the container body. This type of container with cap, for example, has a cylindrical appearance, and is constructed of a container body comprised of a squat cylindrical body for contents storage to which a neck of reduced diameter is connected, and a flat cylindrical cap with a top surface and which is attached to the neck of the container.

For the container with cap, a knock cam mechanism similar to that of a click-type ballpoint pen is used. Some caps can be easily attached and detached by simply pressing the top of the cap. With this type of container with cap, for example, even in a situation in which only one hand can be used, the cap can be freely attached to and detached from the container body simply by pressing the top of the cap.

As a container with cap provided with a knock cam mechanism, there are cosmetic containers like that which is described in Japanese Patent Application Laid-Open No. 2019-501675 (JP-2019-501675-A1). In addition, the structure and operation of the knock cam mechanism of a ballpoint pen are described in a YouTube (registered trademark) video, "How Does a Knocky Pen Work?", online search on Jul. 17, 2020 at www.youtube.com/watch?v=Zv5Qa2kGL04 & feature=emb_title, and at ITmedia, Inc., "Mystery of knock-type ballpoint pen", online search on Jul. 17, 2020 at monoist.atmarkit.co.jp/mn/articles/2003/16/news007.

SUMMARY

In the conventional containers with cap employing a knock cam mechanism, a knock cam and a locking mechanism for engaging and disengaging latches along notches/locking portions of the container body in conjunction with the knock cam mechanism are contained within a cap housing. A large number of parts are required to configure the mechanism and the structure is complicated.

For example, the cosmetic container described in JP-2019-501675-A1 and illustrated in FIG. 2 thereof uses at least seven different types of members (reference numerals 40, 51, 52, 60, 70, 80, 90) to configure the knock cam mechanism and locking mechanism. Further, the locking mechanism (opening/closing operation unit 80) is composed of a hollow cylinder with an enlarged diameter capable of encircling the container body (container 10) that is divided into four members spaced around the longitudinal axis at equiangular intervals (opening/closing wings 83) and a member (push cap 70) that, as it pushes down on a push-button plunger member (knock member 50) as a push-button plunger, acts on the locking mechanism to cause the latches (second latching step 83*b*) to engage a locking portion (locking ridge 14) of the container body.

In addition, in the conventional container with cap, the knock cam mechanism is generally composed of a slender, cylindrical (shaft-shaped) member like that of a ballpoint pen, and this shaft-shaped knock cam mechanism is used as a cap for a thick-bodied container. That is, in the conventional container with cap, a shaft-shaped knock cam mechanism is used, and the vertical linear force acting on a narrow area is distributed over a wide area surrounding the thick neck of the container body and is converted into a rotational force that causes multiple latches to move in and out in the radial direction. Therefore, with the conventional container with cap, the vertical linear force is not evenly transmitted to each of the multiple latches, with the possibility that the multiple latches stop moving in synchrony.

If the cap is attached with multiple latches not operating synchronously and only some of the multiple latches engaged, then, the container body cannot be sealed. If the cap is lifted with not all the latches engaged, the container body may tip over and the contents spilled.

Therefore, the present disclosure proposes a container with cap that is provided with a knock cam mechanism having an uncomplicated structure employing a small number of parts, and that enables the cap to be securely attached to and detached from the container body.

One aspect of the present disclosure for achieving the above-described object provides a container with cap comprising a container body having a cylindrical neck and a cap detachably attached to the neck. The cap includes a hollow cylindrical housing whose end faces are open, a push-button plunger, a ratchet, and an inner lid, each disposed coaxially within the housing and having a bottomed cylindrical shape with a top surface at one end and an opening at another end, with an elastic member inserted between the ratchet and the inner lid. The housing has a plurality of grooves formed in an inner circumferential surface of the housing about a cylindrical axis of the housing, the grooves having a length extending in a vertical direction and a depth extending in a radially outward direction, each of the plurality of grooves has a closed upper end and an open lower end, with deep grooves and shallow grooves formed cyclically about the cylindrical axis and alternating with ribs interposed therebetween. A lower end surface of each of the ribs is a sloped surface sloped from bottom to top in a predetermined circumferential direction around the cylindrical axis of the housing defined as a rotation direction, the sloped surface being continuous with a lower end of a shallow groove adjacent to the rib in the rotation direction, the push-button plunger has a top surface that is exposed from an opening in the top end of the housing, with sliding protrusions that slide up and down in the vertical direction inside each of the plurality of grooves formed around the outer circumferential surface of the push-button plunger and triangular guide protrusions having downward-facing apexes at the bottom formed around the lower end of the push-button plunger about the cylindrical axis. The ratchet has a plurality of radially outwardly projecting sloped protrusions formed in the outer circumferential surface of the ratchet at equiangular intervals around the cylindrical axis, with an upper surface of each of the protrusions having a sloped surface that inclines from boom to top in the rotation direction, the inner lid is fixed to the housing, and a plurality of tabs are formed on the peripheral wall portion forming the side surface at equiangular intervals around the cylindrical axis.

A latch that protrudes radially inward is formed at the tip of each tab, and the plurality of tabs uses stress directed from radially outward to radially inward to elastically deform the latches and project them toward the inner circumferential surface of the inner lid. The elastic member urges the ratchet upward and the container body is provided with a locking portion on the outer circumferential surface of the neck that engages the latches. When the ratchet is pushed down with a downward pushing action exerted on the push-button plunger, after the upper ends of the sloped protrusions positioned at the grooves reach the lower end position of the ribs, the ratchet is guided by the sloped surface of the ribs and rotates in the direction of rotation until it reaches the position of the adjacent groove, and the ratchet switches alternately between an upper position when the sloped protrusion is in the deep groove position and a lower position when the sloped protrusion is in the shallow groove position. When the ratchet is in the lower position, the tabs are pushed radially inward by the inner circumferential surface of the ratchet and the latches of the inner lid surrounding the neck engage the locking portion, and when the ratchet is in the upper position, engagement of the latches and the locking portion is released.

The ratchet may have rotation assist protrusions with downward-facing apexes formed along the lower end thereof around the cylindrical axis at a predetermined pitch and the inner lid may be provided with a flange around the lower end, with release assist protrusions with upward-facing apexes formed on the upper surface of the flange around the cylindrical axis at the same predetermined pitch, such that the rotation assist protrusions and the release assist protrusions are parallel to each other, are tilted with respect to the rotation direction, have upper surfaces that slope in opposite directions vertically with respect to the rotation direction, and are out of phase in the vertical direction. When the push-button plunger is pushed in from the state in which the latches engage the locking portion, the rotation assist protrusions are guided by the slope of the release assist protrusions and the ratchet rotates in the rotation direction.

Air-hole vents that communicate with the outside to allow an exchange of air may be formed in both the top surface of the ratchet and the top surface of the push-button plunger. The container with cap can have three or more of the sloped protrusions.

Effect of the Disclosure

According to the present disclosure, provided is a container with cap equipped with a knock cam mechanism having an uncomplicated structure and employing a small number of parts, and which enables the cap to be securely attached to and detached from the container body. Other effects and advantages will become clear from the description that follows.

DETAILED DESCRIPTION

Figure 1A:
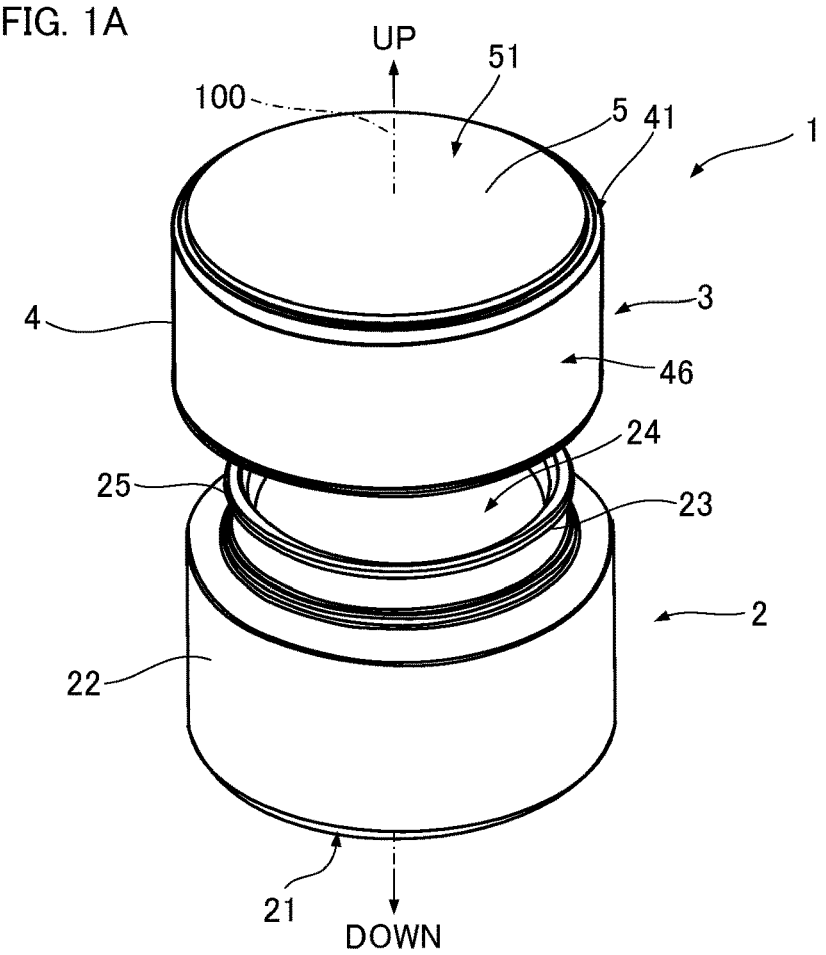
FIGS. 1A-1B are diagrams illustrating the external appearance of a container with cap according to an embodiment of the present disclosure.

Embodiments of the present disclosure will be described with reference to the accompanying drawings, in which the same or similar parts are designated by the same reference numerals and duplicate description thereof omitted.

EMBODIMENTS OF THE DISCLOSURE

Figure 1B:
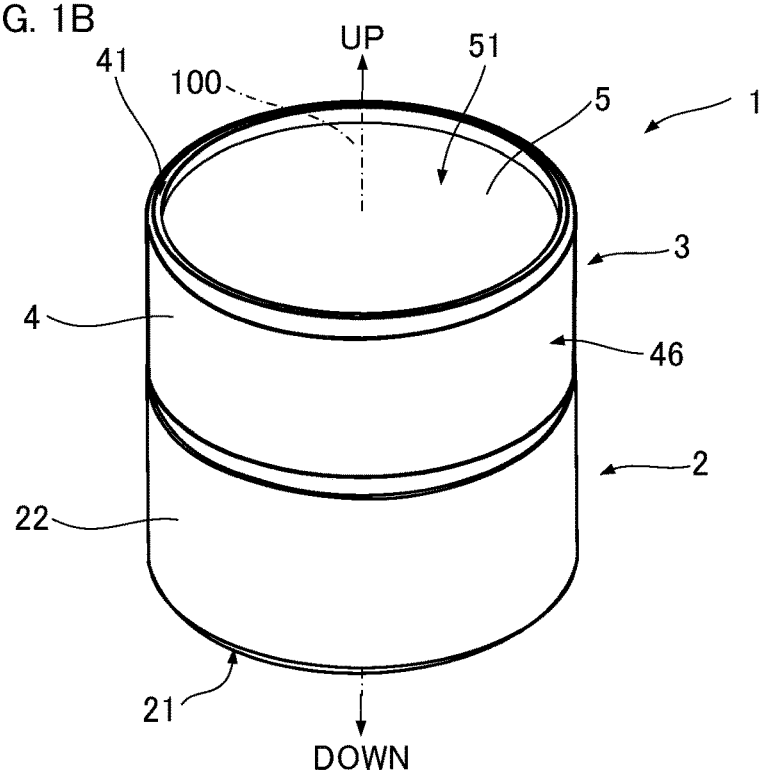

FIGS. 1A and 1B are externals view of a container with cap according to an embodiment of the present disclosure (hereinafter also referred to as container 1). The container 1 is composed of a cylindrical container body 2 and a cylindrical cap 3 mounted coaxially to the container body 2. FIG. 1A illustrates a state in which the cap is detached from the container body 2 and FIG. 1B illustrates a state in which the cap 3 is attached to the container body 2.

It is to be noted that the longitudinal axis of the container body 2 and the cap 3 (hereinafter also referred to as the cylindrical axis or simply axis 100) is taken to be the vertical direction. If the vertical direction is defined by a bottom 21 of the container body 2 at the bottom, then as illustrated in FIG. 1A the container body 2 is composed of a cylindrical body portion 22 in which the contents are stored and a cylindrical neck 23 having a reduced diameter with respect to the body portion 22 formed atop the cylindrical body portion 22. The upper end of the neck 23 is a mouth 24, and the mouth 24 and the inside of the body portion 22 are connected via the neck 23. A flange 25 is formed around the mouth 24 of the neck 23.

The cap 3 has an outer diameter that is the same as that of the body portion 22 of the container body 2. A housing 4 as an exterior houses a knock cam mechanism and a locking mechanism that, in conjunction with the knock cam mechanism, moves latches (not illustrated) in and out in the radial direction to engage the flange 25. That is, in the container 1 according to the present embodiment, the flange 25 of the container body 2 is a locking portion that engages the latches.

A top surface 51 of a push-button plunger 5 that comprises the knock cam mechanism is exposed at a top surface 41 of the housing 4. In a released state in which the engagement between the latches and the flange 25 is disengaged, the push-button plunger 5 projects from the top surface 41 of the housing 4. In contrast, as illustrated in FIG. 1 (B), when the latches built into the cap 3 are engaged with the flange 25 in an attached state, the push-button plunger 5 is depressed down into the housing 4.

Container with Cap

Figure 2:
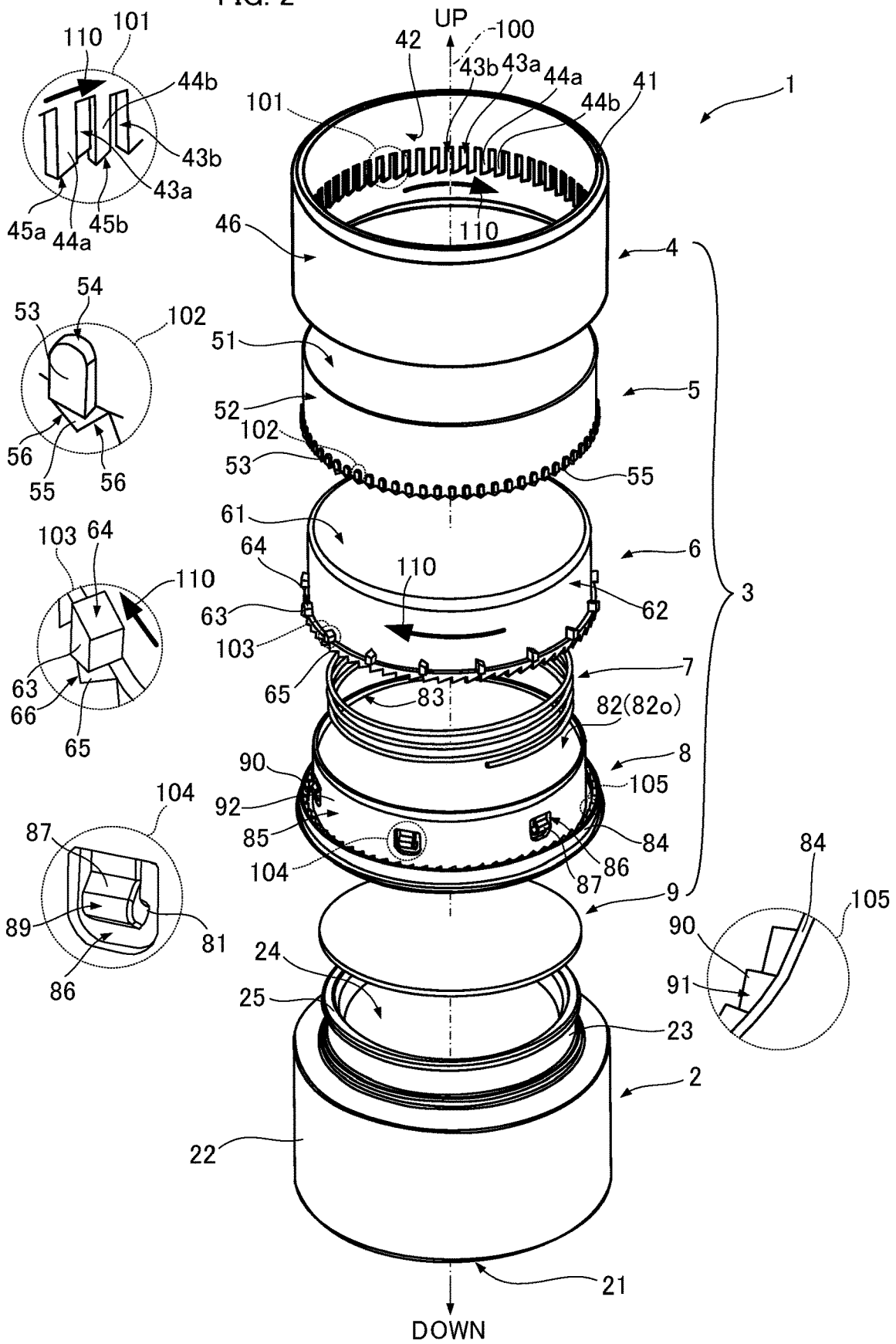
FIG. 2 is an exploded perspective view of the container viewed from above, illustrating a configuration of the container with cap.
Figure 3:
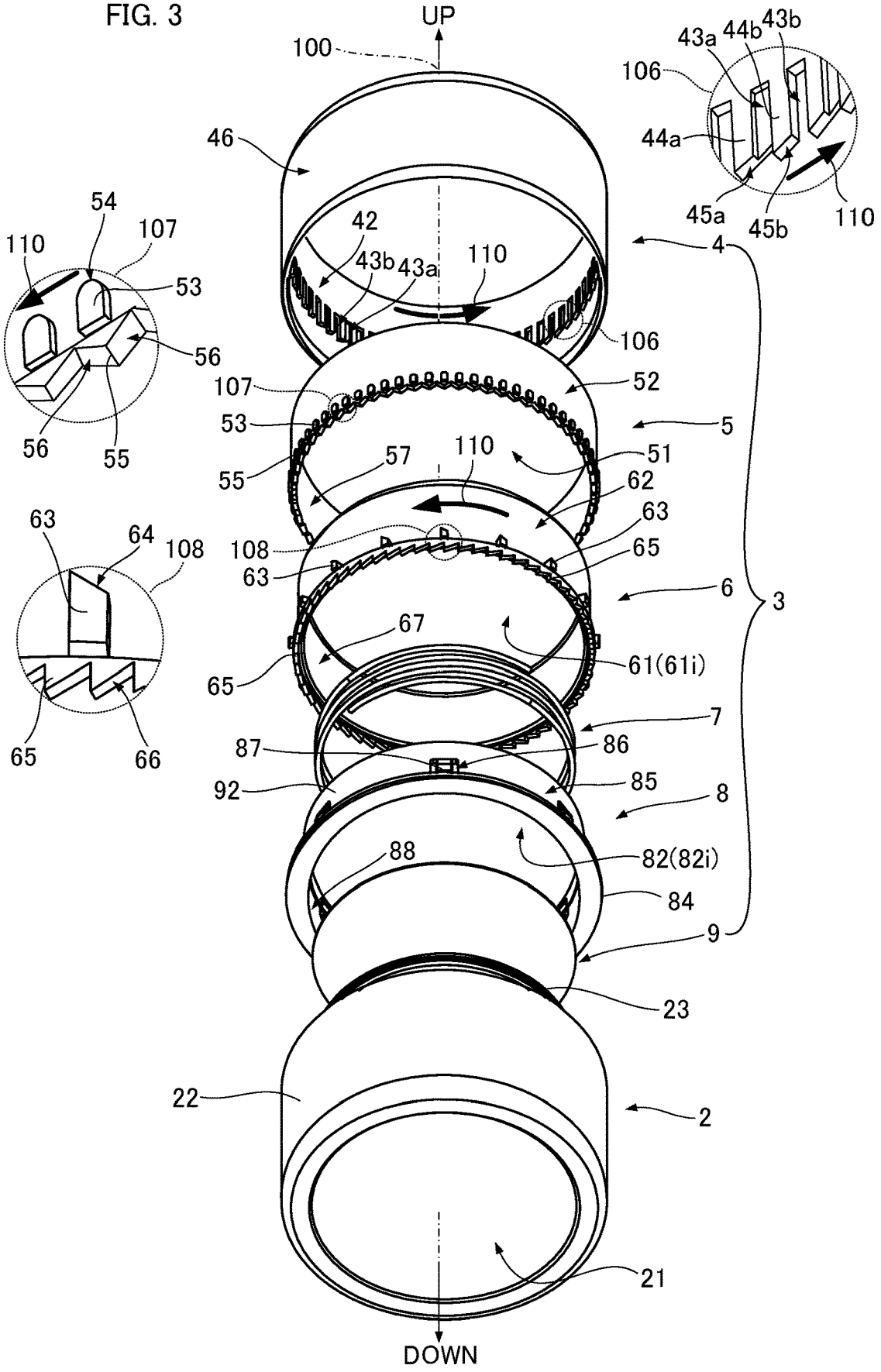
FIG. 3 is an exploded perspective view of the container viewed from below, illustrating the configuration of the container with cap.

FIGS. 2 and 3 are exploded perspective views illustrating the configuration of the container 1, with FIG. 2 illustrating an exploded perspective view of the container 1 when viewed from above and FIG. 3 illustrating an exploded perspective view of the container 1 when viewed from below. In FIGS. 2 and 3, the cap 3 is illustrated in exploded perspective view, with enlarged views of areas enclosed in dotted-line circles (101 to 108) also illustrated.

As illustrated in FIGS. 2 and 3, the cap 3 is composed of the housing 4, the push-button plunger 5, a ratchet 6, a spring 7, an inner lid 8, and a packing 9. Of this configuration, the housing 4, the push-button plunger 5, the ratchet 6, and the spring 7 comprise the knock cam mechanism. The inner lid 8, as illustrated in the enlarged view of region 104 in FIG. 2, is provided with latches 81 that project radially outward and retract radially inward in conjunction with the knock cam mechanism.

The housing 4 is a molded product made of a hard resin such as polyketone (POK), polyacetal (POM), ABS, or the like. The housing 4 also serves as the outer cam of the knock cam mechanism. As illustrated in the enlarged diagrams 101 in FIGS. 2 and 106 in FIG. 3, grooves (43*a*, 43*b*) having a length in the axis 100 direction and depths radially outward are formed in an inner circumferential surface 42 of the housing 4 at equiangular intervals around the axis 100. In the present embodiment, a total of 64 grooves (43*a*, 43*b*) are formed at equal intervals around the axis 100. The grooves (43*a*, 43*b*) are of two types of different depths, with shallow grooves 43*a* alternating with deep grooves 43*b* via interposed adjacent ribs (44*a*, 44*b*) in the circumferential direction.

The lower end of each groove (43*a*, 43*b*) is open and the upper end is closed. The lower ends of the ribs (44*a*, 44*b*) are sloped surfaces (45*a*, 45*b*) that incline at a predetermined angle and repeat cyclically so as to form a saw-tooth wave shape in the circumferential direction. When viewed from above, sloped surfaces (45*a*, 45*b*) at each rib (44*a*, 44*b*) incline from the bottom to the top in the clockwise direction. If, as illustrated by the thick arrow in the figure, the clockwise direction (thick arrow direction in the figure) when viewed from above is referred to as the rotation direction 110, then the sloped surface 45*a* of the rib 44*a* is continuous with the slope of the lower end of the shallow groove 43*a* that is adjacent to the rib 44*a* on rotation direction 110 side. Therefore, the width in the radial direction of the sloped surface 45*a* narrows in the region where the shallow groove 43*a* is formed. The outer cam in the knock cam mechanism is formed by the grooves (43*a*, 43*b*) and the ribs (44*a*, 44*b*) and the sloped surface at the lower end of the shallow groove 43. It is to be noted that the thickness of the side wall 46 of the housing 4 is such that it forms a thick region continuous with the ribs (44*a*, 44*b*) on the upper end side and a thin area continuous with the deep grooves 43 on the lower end side.

The push-button plunger 5 is a molded product made of, for example, POK, POM, ABS, etc., and has a top surface 51 and a flattened cylindrical shape that opens downward. The push-button plunger 5 is slidable inward of the housing 4. Specifically, protrusions (hereinafter, sliding protrusions 53) corresponding to each of the grooves (43*a*, 43*b*) in the housing 4 that slide vertically up and down inside each of the grooves (43*a*, 43*b*) are formed around the outer circumferential surface 52 of the lower end side of the push-button plunger 5. As illustrated in the enlarged view of the area 102 in FIG. 2 and the enlarged view of the area 107 in FIG. 3, a tip 54 of the sliding protrusion 53 forms a semicircular shape that is convex, to slide smoothly up and down in the vertical direction inside the grooves (43*a*, 43*b*). An outer circumferential surface 52 of the push-button plunger 5 contacts and slides over the above-described thick region on the inner circumferential surface 42 of the housing 4. Triangular protrusions (hereinafter also referred to as guide protrusions 55) having their apexes at the bottom are formed around the lower end of the push-button plunger 5 about the axis 100. The guide protrusions 55 have the same pitch as the sliding protrusions 53 and are positioned so as to bisect the width of the sliding protrusions 55 in the clockwise direction.

Like the push-button plunger 5, the ratchet 6 has a top surface 61, has a flat cylindrical shape that opens downward, and is a molded product made of POK, POM, ABS or the like. Protrusions 63 projecting radially outward in blocks are formed around the axis 100 at equiangular intervals on the outer circumferential surface 62 of the ratchet 6. In the present embodiment, 16 protrusions 63 are formed. The ratchet 6 is configured so that the outer circumferential surface 62 rotates around the axis 100 while contacting the inner circumferential surface 57 of the push-button plunger 5.

As illustrated in the enlarged view of the area 103 in FIG. 2 and the enlarged view of the area 108 in FIG. 3, the upper surface 64 of the protrusion 63 formed on the outer circumferential surface 62 of the ratchet 6 is inclined from the bottom to the top in the rotation direction 110, and that slope is parallel to the slope of the sloped surfaces of the above-described ribs (44*a*, 44*b*) formed in the housing 4 ribs and the sloped surfaces (45*a*, 45*b*) at the lower ends of the shallow groove 43*a*. When the push-button plunger 5 and the ratchet 6 are inserted into the housing 4, the upper surfaces 64 of the protrusions (hereinafter also referred to as sloped protrusions 63) formed around the outer circumferential surface 62 of the ratchet 6 contact the lower surfaces 56 of the guide protrusions 55 formed in the lower end of the push-button plunger 5 and the above-described sloped surfaces (45*a*, 45*b*) that form the outer cam in the housing 4. The sloped protrusions 63 slide over the inner circumferential surface 42 of the housing 4 in the region where the deep grooves 43*b* are formed. In the container 1 according to the present embodiment, saw-tooth-shaped protrusions 65 with the lower part as the apex are formed along the bottom of the ratchet 6 circulates, such that the lower end of the ratchet 6 has a saw-tooth wave shape.

The inner lid 8 is a molded product made of a resin such as polypropylene (PP) or polyethylene terephthalate (PET), has a flattened cylindrical shape with a top surface 82, and opens downward. The periphery of the top surface 82 is formed into an upwardly raised lip 83 and the bottom of the inner lid 8 has a flange 84. In the fully assembled state of the cap 3, the outer rim of the flange contacts the inner circumferential surface 42 of the housing 4. The inner lid 8 is fixed to the housing 4 by adhesive applied at this region of contact.

The peripheral wall 92 forming the sides of the cylindrical inner lid 8 has openings 86 therein for connecting the inside and the outside formed at equiangular intervals about the axis 100. In the present embodiment, the openings 86 are formed at 6 locations. As illustrated in the enlarged view of the region 104 in FIG. 2, inside each of the openings 86 a tab 87 suspended from the upper edge of each opening 86 is formed. At an intermediate portion heading downward from the upper edge of the opening 86, each tab 87 bends radially outward once with respect to the outer circumferential surface of the inner lid 8 and then bends radially inward again, with the tip pointing radially inward. These tips of the tabs 87 form the latches 81 that detachably engage the flange 25 of the container body 2.

In the attached state, the portion of the tab 87 bent so as to protrude outward in the radial direction (hereinafter also referred to as the bent portion 89) is for the purpose of applying force to the tab 87 in the radially inward direction. When a force in the radially inward direction is applied to the bent portions 89, the tab 87 flexes radially inward due to elasticity and the latches 81 project toward the inner circumferential surface 88 side of the inner lid 8. As a result, the latches 81 slip below the flange 25 of the container body 2, the latches 81 and the flange 25 are engaged, and the cap 3 is in the attached state. When the stress on the bent portion 89 disappears, the tab 87 returns to its initial state, the latches 81 retreat radially outward, and the engagement between the latches 81 and the flange 25 is released.

In the container 1 according to the present embodiment, as illustrated in the enlarged view of the region 105 in FIG. 2, saw-tooth-shaped protrusions 90 with the apexes at the top are formed all the way around the upper surface of the flange 84 of the inner lid 8, such that the upper surface of the flange 84 is formed into a saw-tooth wave shape. These protrusions (hereinafter also referred to as release assist protrusions 90) are formed into a shape that meshes with protrusions formed in the bottom of the ratchet 6 (hereinafter referred to as rotation assist protrusions 65). That is, the release assist protrusions 90 have the same pitch as the rotation assist protrusions 65 and have sloped surfaces 91 that parallel the sloped surfaces 66 of the rotation assist protrusions 65. The pitch of rotation assist protrusions 65 and the release assist protrusions 90 about the axis 100 are the same as that of the grooves (43*a*, 43*b*) of the housing 4, the sliding protrusions 53 of the push-button plunger 5, and the guide protrusions 55. Further, the rotation assist protrusions 65 and the release assist protrusions 90 are purposely formed so as to be out of phase in the attached state of the cap.

A spring 7 is housed between the outside of the top surface 82 of the inner lid 8 (FIG. 2, reference numeral 82*o*) and the inside of the top surface 61 of the ratchet 6 (FIG. 3, reference numeral 61*i*). A disk-shaped packing 9 is fitted to the inside of the top surface 82 of the inner lid 8 (FIG. 3, reference numeral 82*i*). In the inner lid 8, the region above the flange 84 is housed inside the ratchet 6, and the ratchet 6 moves up and down relative to the inner lid 8. In the present embodiment, as described above, a lip 83 is formed around the inside of the top surface 82 of the inner lid 8 and the spring 7 is arranged inside the lip 83 to ensure coaxial disposition with other members (5, 6, 8).

Cap Operation

Next, the operation of attaching the cap 3 having the above-described configuration to the container body 2 is described. FIGS. 4A-4D are diagrams illustrating the operation of attaching the cap 3 to the container body 2. For ease of understanding, a portion of the push-button plunger 5 and the ratchet 6 is illustrated as a developed view around the axis 100. Further, in FIGS. 4A-4D, the grooves (43*a*, 43*b*) formed in the inner circumferential surface 42 of the housing 4 are indicated by dotted lines.

FIGS. 4A to 4D illustrate stages in the operation until the cap 3 in the released state is attached to the container body 2. Each sliding protrusion 53 of the push-button plunger 5 is slidably contained within a corresponding one of the grooves (43*a*, 43*b*, respectively). The ratchet 6 is constantly urged upward by the spring 7, so that the upper surfaces 64 of the sloped protrusions 63 contacts the lower surfaces 56 of the guide protrusions 55 of the push-button plunger 5 and the push-button plunger 5 is urged upward.

Figure 4A:
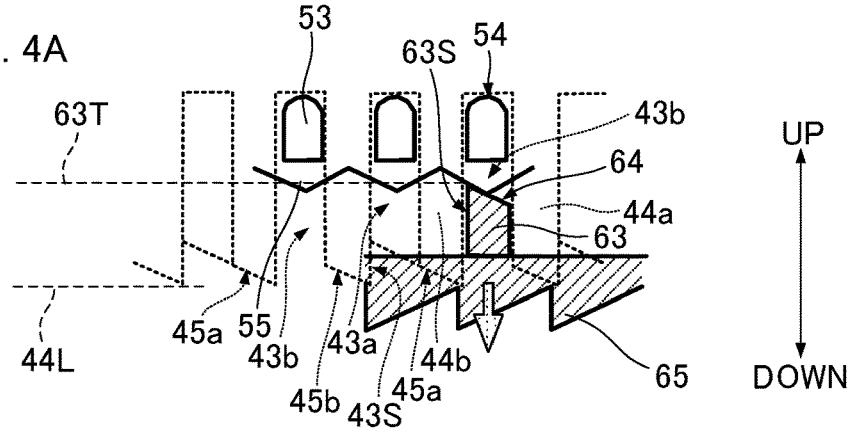
FIGS. 4A-4D are diagrams illustrating an operation of attaching a cap to a container body in the container with cap.

In FIG. 4A, when the cap 3 is in the released state, the sloped protrusions 63 are inserted into the deep groove 43*b* and the tips 54 of the sliding protrusions 53 contact the upper ends of the grooves (43*a*, 43*b*). The upper surfaces 64 of each of the sloped protrusions 63 and the lower surfaces 56 of each of the guide protrusions 55 are inclined and contact each other so as to mesh. It is to be noted that the vertical position of the ratchet 6 in this attached state is defined as the upper position.

Figure 4B:
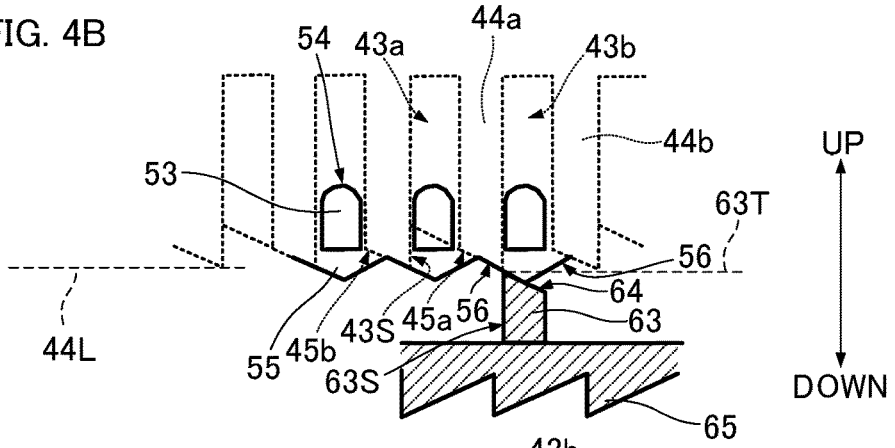

Next, as illustrated by the halftone dot arrow in FIG. 4A, the push-button plunger 5 is pressed downward against the upward urging force exerted by the spring 7 to push the ratchet 6 down. When the position 63T of the upper end of the sloped protrusion 63 reaches the position 44L at the lower end of the ribs (44*a*, 44*b*) as illustrated in FIG. 4B, the inclined upper surface 64 of the sloped protrusion 63 is guided from the lower end position 63T of the rib 44*a* to the sloped surface 45*a* continuous with the lower end of the shallow groove 43 and the ratchet 6 rotates in the rotation direction 110. That is, as illustrated by the blank arrow in FIG. 4C, the urging force of the spring 7 pushing the ratchet 6 upward is converted into a rotational force in the clockwise direction 110 by the cam composed of the outer cam formed on the inner surface of the housing 4 and the sloped protrusion 63.

Figure 4C:
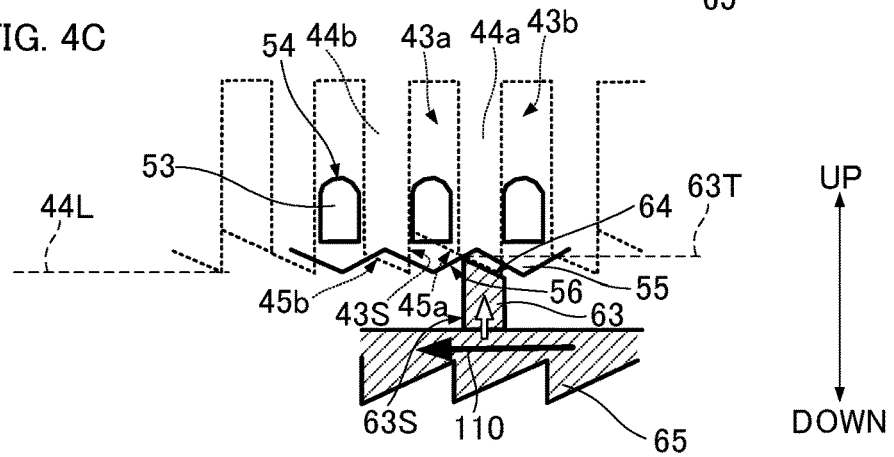

Next, as illustrated in FIG. 4C, as the ratchet 6 continues to rotate, the sloped protrusion 63 maintains contact with the guide protrusions 55 of the push-button plunger 5 at the upper end position 63T and the push-button plunger 5 is pushed upward with the rotation of the ratchet 6.

Figure 4D:
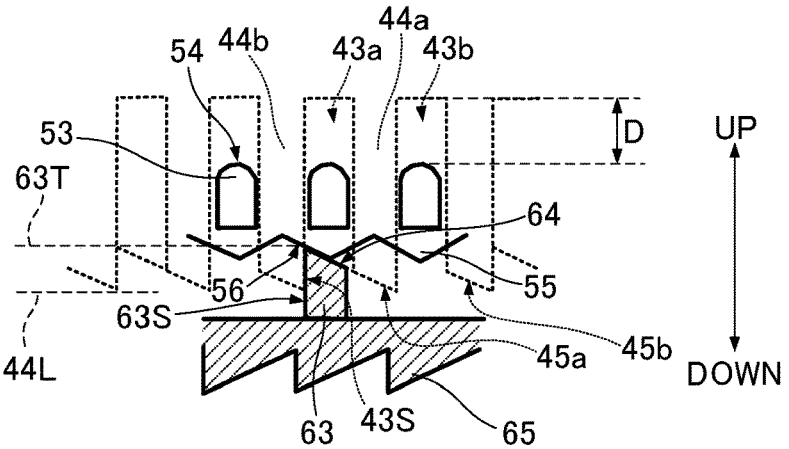

Finally, as illustrated in FIG. 4D, as the sloped protrusion 63 is guided by the sloped surface 45*a* continuous from the lower end of the rib 44*a* and moves to the region where the shallow groove 43*a* is formed, a side surface 63S on the rotation direction 110 side of the sloped protrusion 63 contacts a side surface 43S of the rib 44*b* on the rotation direction 110 side of the shallow groove 43*a* to stop the rotation of the ratchet 6. Unlike the sliding protrusion 53 of the push-button plunger 5, the sloped protrusion 63, which slides over the inner circumferential surface 42 of the housing 4 in the region of the deep groove 43*b*, cannot enter the shallow groove 43*a* and is stopped from moving upward. As a result, the ratchet 6, along with the push-button plunger 5, stays pushed in at a position lower than the released state by a distance D. It is to be noted that, in the following description, the vertical position of the ratchet 6 when the sloped protrusion 63 is situated in the region of the shallow groove 43*a* is defined as a bottom position.

As described above, according to the container 1 of the embodiment, the grooves (43*a*, 43*b*) formed in the inner circumferential surface 42 of the housing and the sloped surfaces (45*a*, 45*b*) formed at the lower ends of the ribs (44*a*, 44*b*) comprise the outer cam that serves as the cam body is formed, and a cam is formed by using the sloped protrusion 63 of the ratchet 6 as a cam follower. In the knock cam mechanism, each time the push-button plunger 5 that is constantly urged upward via the ratchet 6 pushes down on the ratchet 6 via the sloped protrusions 63, the push-button plunger 5 operates the cam and switches the position of the ratchet 6 between a top position and the bottom position. When the ratchet 6 is in the bottom position, the cap 3 is attached to the container body 2 so as not to fall off from the container.

Figure 5:
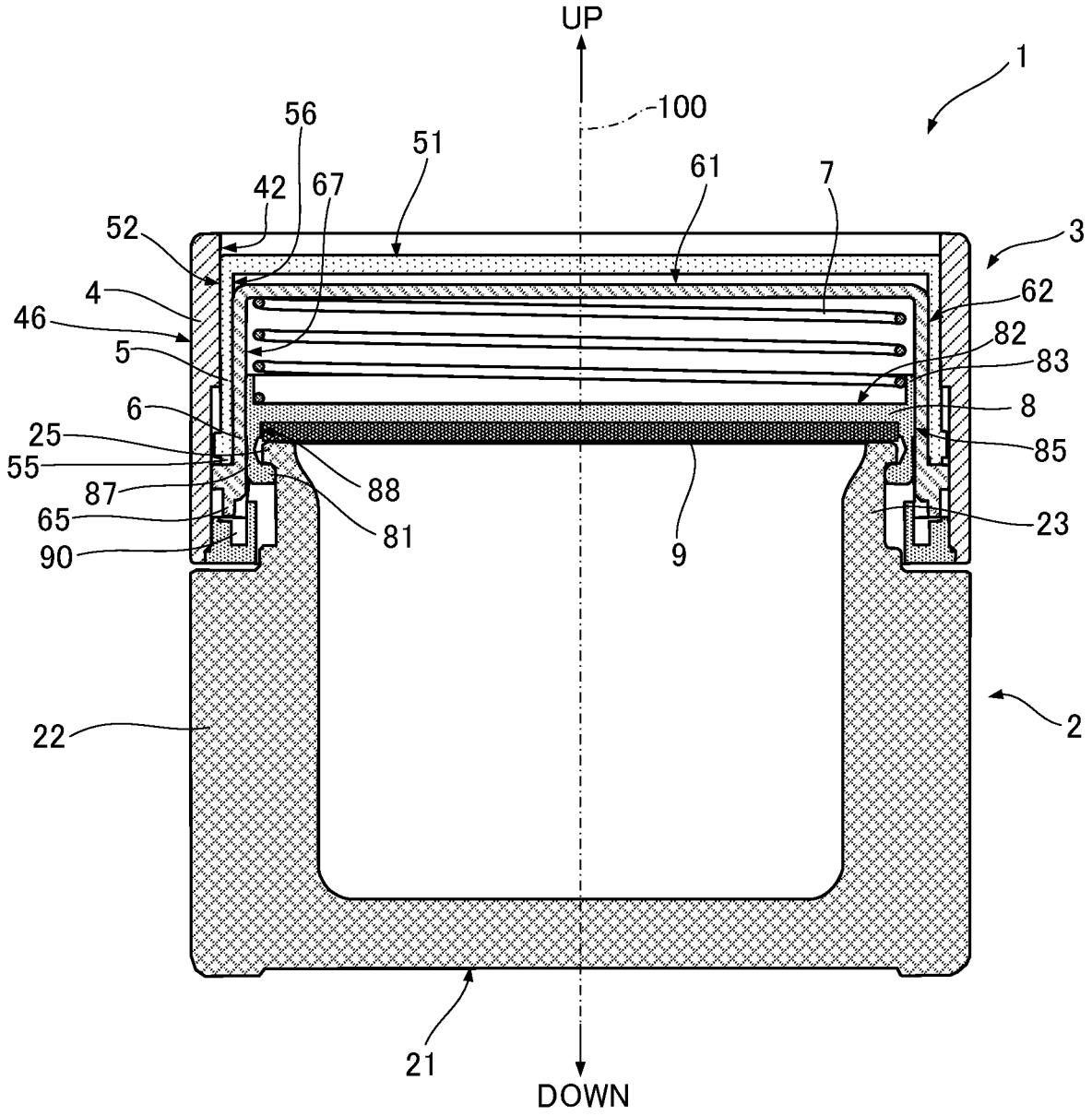
FIG. 5 is a cross-sectional view of the container with cap illustrating a state in which the cap is attached.

FIG. 5 illustrates a cross-sectional view of the container 1 with the cap 3 attached. As illustrated in FIG. 5, the lower end side of the inner circumferential surface 67 of the ratchet 6 covers the bent portion 89 of the tab 87 formed on the inner lid 8, the tab 87 bends radially inward, and the latches 81 protrude radially inward with respect to the inner circumferential surface 88 of the inner lid 8. The latches 81 engage the flange 25 of the container body 2 while supporting the flange 25 from below. As a result, the upward movement of the cap 3 is stopped so that the cap 3 does not fall off from the container.

Figure 6A:
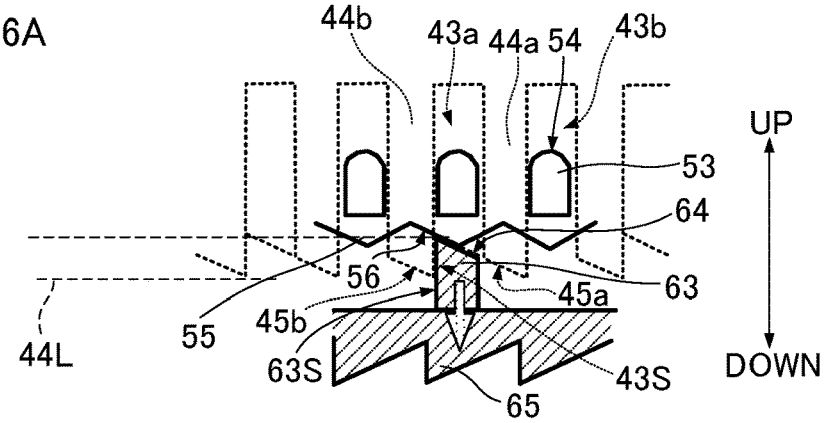
FIGS. 6A-6D are diagrams illustrating an operation of releasing the cap from its state of attachment to the container body.
Figure 6B:
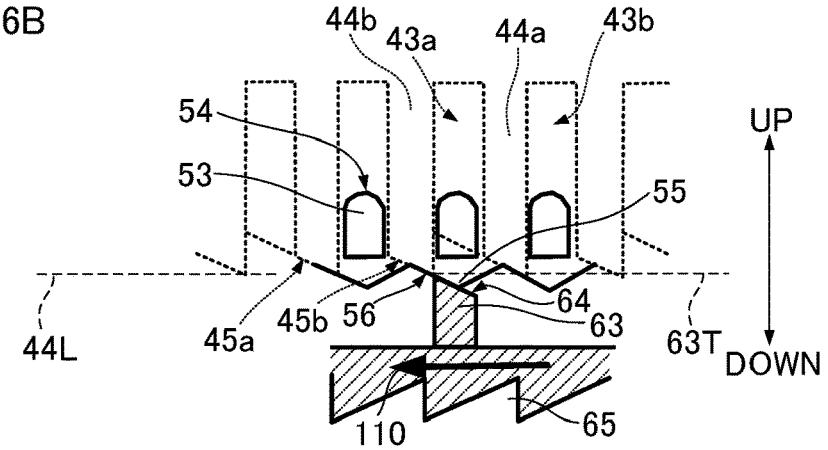

Next, the operation of shifting the cap 3 from the attached state to the released state is described. FIGS. 6A to 6D illustrate release of the cap 3. That is, FIGS. 6A to 6D illustrate the transition from a state of attachment of the cap 3 to a state of release of the cap 3. As illustrated in FIG. 6A, when the cap 3 is in its attached state, the ratchet 6 is in the lower position and the sloped protrusion 63 stays in the region where the shallow groove 43*a* is formed. As illustrated by the halftone dot arrow in the figure, the push-button plunger 5 is pressed downward from the attached state. Then, as illustrated in FIG. 6B, when the upper end 63T of the sloped protrusion 63 moves to the position 44L of the lower end of the rib 44*a*, the ratchet 6, due to the upward urging force of the spring 7, rotates in the rotation direction 110 as the inclined upper surface 64 of the sloped protrusion 63 is guided by the slope 45*b* of the rib 44*b* on the rotation direction 110 side of the shallow groove 43*a*.

Figure 6C:
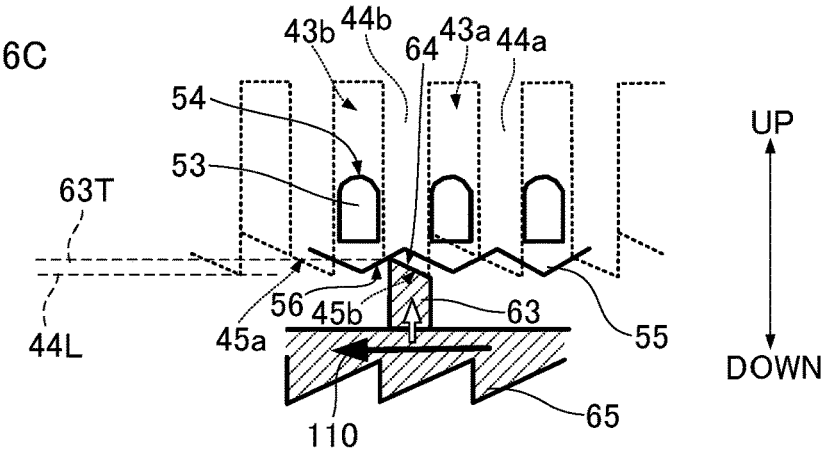
Figure 6D:
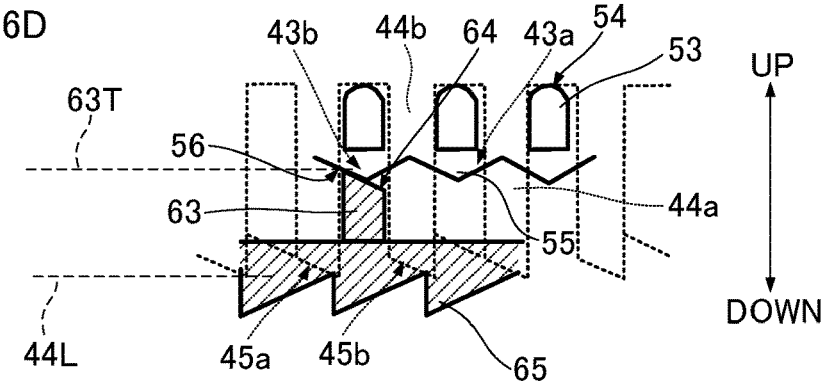

During the rotation, as illustrated in FIG. 6C, contact between the guide protrusions 55 and the sloped protrusion 63 is maintained at the upper surface 64, and the push-button plunger 5 is pressed upward as the ratchet 6 rotates as illustrated by a white arrow in the figure. Then, as illustrated in FIG. 6D, as the sloped protrusion 63 is guided to the position of the deep groove 43*b*, the sloped protrusion 63 enters the deep groove 43*b*. As a result, the ratchet 6 is pushed up together with the push-button plunger 5 by the urging force of the spring 7 and the cap 3 is released.

Figure 7:
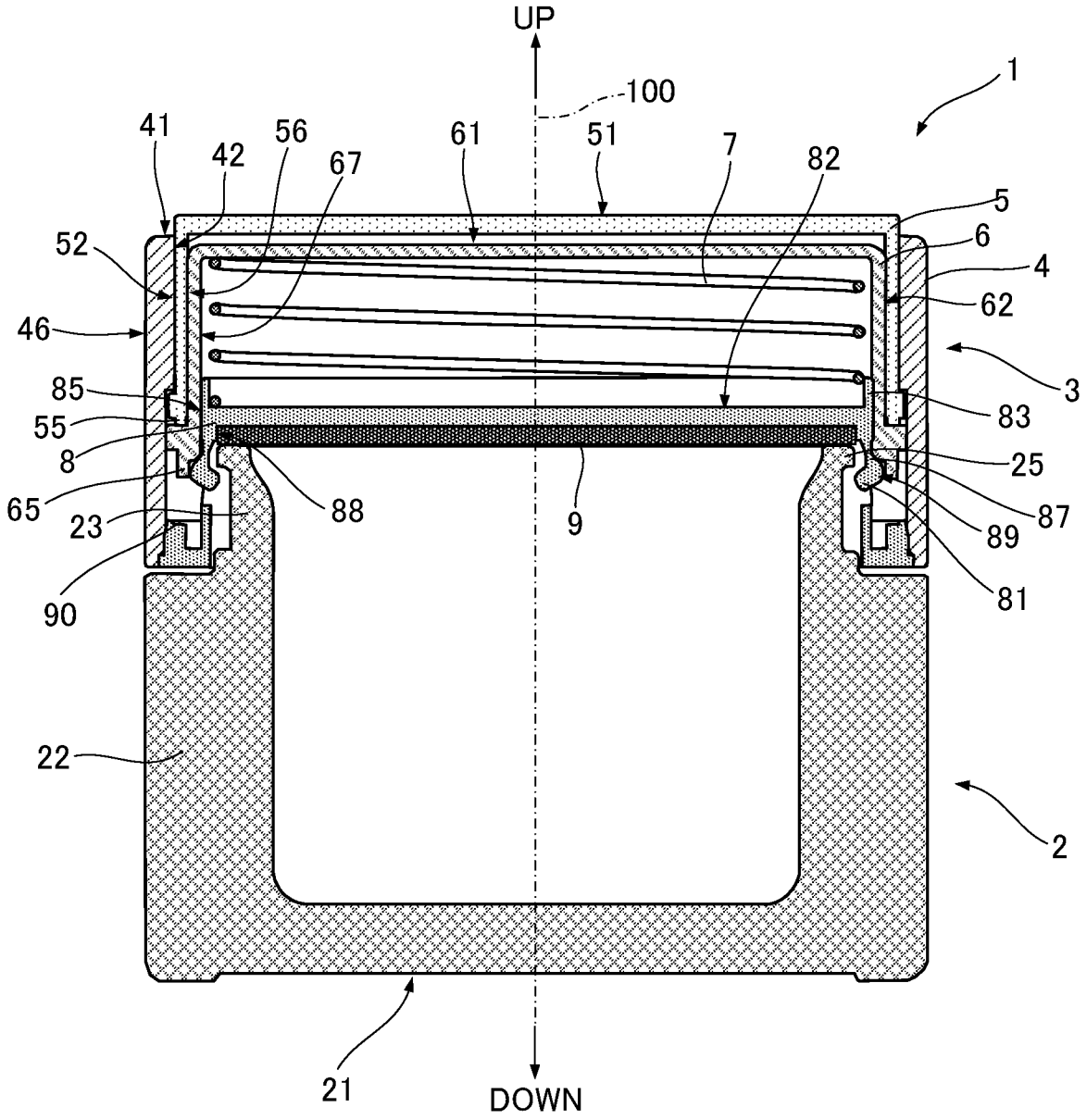
FIG. 7 is a cross-sectional view of the container with cap illustrating a state in which the cap is released.

FIG. 7 illustrates a cross-sectional view of the container 1 in the released state. As illustrated in FIG. 7, by the ratchet 6 moving upward the tab 87 of the inner lid 8 is released from the force that had been exerted radially inwardly on the bent portion 89. As a result, the bent portion 89 protrudes in the radially outward from the outer circumferential surface 85 of the inner lid 8 and the tab 87 returns to its original shape. Then, as the tab 87 returns to its original shape, the latches 81 that were engaged with the flange 25 of the container body 2 move radially outward, the engagement between the latches 81 and the flange 25 is released and the cap 3 can then be detached from the container body 2.

In the container 1 according to the above-described embodiment the housing 4 also serves as an outer cam, and thus the knock cam mechanism is constructed of an extremely small number of parts. The housing 4 has a large number of grooves (43*a*, 43*b*) formed in the inner circumferential surface 42 thereof at equiangular intervals about the axis 100. The push-button plunger 5 has sliding protrusions 53 each corresponding to one of the grooves (43*a*, 43*b*), and each sliding protrusion 53 slides vertically up and down inside a corresponding one of the grooves (43*a*, 43*b*).

The outer circumferential surface 62 of the ratchet 6 contacts the inner circumferential surface 57 of the push-button plunger 5 and the sloped protrusions 63 slide over the inner circumferential surface 42 of the housing 4. Therefore, the push-button plunger 5 and the ratchet 6 are isotropically supported over the entire circumference of the inner circumferential surface 42 of the housing 4, and move up and down without tilting with respect to the axis 100.

Further, the outer circumferential surface 85 of the inner lid 8 surrounding the neck 23 of the container body 2 slides over the inner circumferential surface 67 of the ratchet 6, such that each of the tabs 87 formed around the peripheral wall 92 of the inner lid 8 at equal intervals is evenly pressed by the inner circumferential surface 67 of the ratchet 6 from the radially outward direction toward the radially inward direction. As a result, the latches 81 formed at the tip of the tabs 87 protrude from the inner circumferential surface 88 of the inner lid 8 to securely engage the latches 81 with the flange 25 of the container body 2 as the push-button plunger 5 is pressed downward. Similarly, when the cap 3 is detached, the latches 81 retract evenly in the radially outward direction and the engagement between the latches 81 and the flange 25 of the container body 2 can be reliably released. It is to be noted that the locking mechanism of the container 1 according to the present embodiment is an uncomplicated structure that merely elastically deforms radially inward the tabs 87 having latches 81 formed at the tips thereof to enable the cap 3 to be attached.

According to the container 1 according to the present embodiment, the cap 3 can be securely attached to and detached from the container body 2 by simply pressing down on the push-button plunger 5. The mechanism required for attachment and detachment of the cap is an uncomplicated structure composed of a small number of parts, and thus can be provided at a lower cost. The uncomplicated structure and small number of parts makes the container 1 less likely to break down and highly reliable.

Release Assist Mechanism

In the attached state of the cap 3 the spring 7 of is compressed, and so to release the cap 3 the compressed spring 7 must be further compressed. However, due to the strong upward stress caused by the compressed spring 7, the friction between the guide protrusions 55 of the push-button plunger 5 and the sloped protrusions 63 of the ratchet 6 increases and there is a possibility that the ratchet 6 becomes unable to rotate smoothly. If the packing 9 is thick, then when the push-button plunger 5 is pressed the packing may be compressed without the spring 7 being compressed and it may become difficult to move the push-button plunger 5 and the ratchet 6 downward relative to the housing 4.

Further, at the time of release, immediately after moving the sloped protrusions 63 positioned at shallow grooves 43*a* to the position 44L of the lower ends of the ribs (44*a*, 44*b*), the tops of the sloped protrusion 63 and the tops of the sloped surfaces of the ribs (44*a*, 44*b*) contact each other in the form of a line, generating an extremely large frictional force between the sloped surfaces 45*b* of the ribs 44*b* on the side of the shallow grooves 43*a* in the rotation direction 110 and the sloped protrusions 63 that can obstruct the rotational movement of the ratchet 6. Therefore, the container 1 according to the present embodiment is equipped with a release assist mechanism to more reliably shift the cap 3 in the attached state to the released state.

Figure 8A:
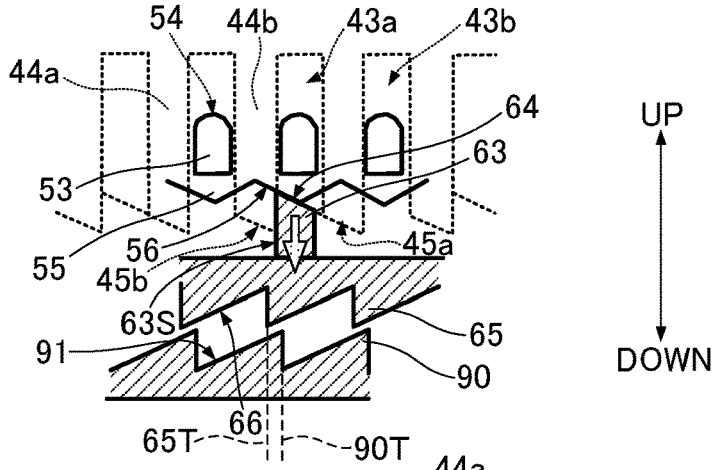
FIGS. 8A-8D are diagrams illustrating an operation of a release assist mechanism of the container with cap.

FIGS. 8A-8D illustrate the operation of the release assist mechanism. That is, FIGS. 8A to 8D illustrate the transitions in the operation of the release assist mechanism. The release assist mechanism is composed of rotation assist protrusions 65 on the ratchet 6 and release assist projections 90 on the inner lid 8. First, as illustrated in FIG. 8A, when the cap 3 is in the attached state, the sloped protrusions 63 are inserted into the shallow grooves 43*a*. The rotation assist protrusions 65 and the release assist protrusions 90 are separated from each other in the vertical direction.

As described above, although the rotation assist protrusions 65 and the release assist protrusions 90 have the same pitch and direction of inclination, they are out of phase. That is, the vertices (65T, 90T) of the rotation assist protrusions 65 and the release assist protrusions 90 are offset from each other in the rotation direction 110, and their respective surfaces (66, 91) are designed to overlap in the vertical direction. In addition, the direction of inclination of the sloped surfaces (66, 91) of the rotation assist protrusions 65 and the release assist protrusions 90 is vertically symmetrical with respect to the sloped surfaces (45*a*, 45*b*) of the ribs (44*a*, 44*b*) formed in the inner circumferential surface 42 of the housing 4. That is, they are inclined from the upper side to the lower side in the rotation direction 110.

Figure 8B:
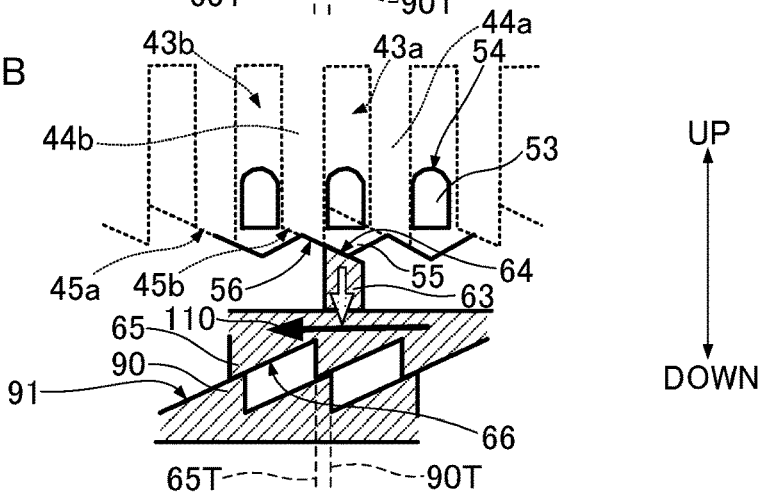
Figure 8C:
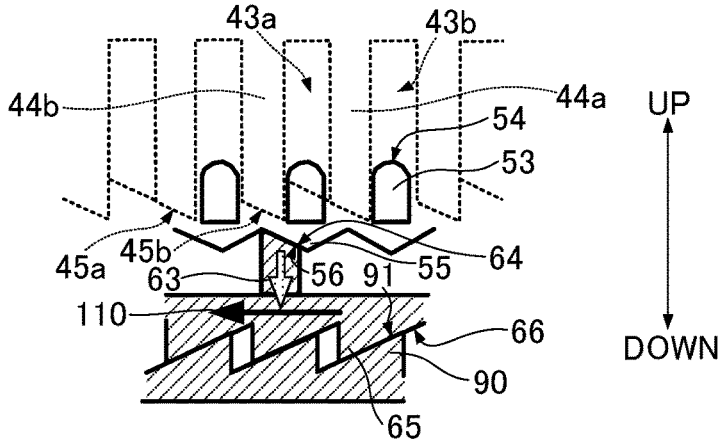
Figure 8D:
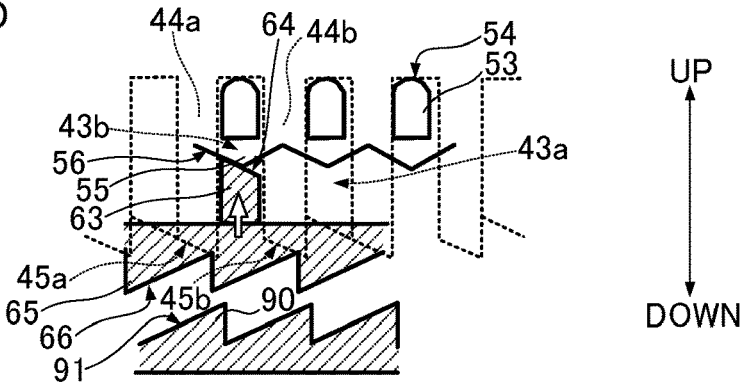

As illustrated in FIG. 8B, when the push-button plunger 5 is pressed downward from the attached state the ratchet 6 is pushed downward, and the rotation assist protrusions 65 and the release assist protrusions 90 contact each other. As illustrated in FIG. 8C, when the push-button plunger 5 is pressed further downward and the ratchet 6 is pushed further downward, the rotation assist protrusions 65 are guided by the sloped surface 91 of the release assist protrusions 90, and the ratchet 6 is rotated in the rotation direction 110. In this state, if the pressing force on the push-button plunger 5 is weakened and the ratchet 6 is moved upward, the upper surface 64 of the sloped protrusions 63 contacts the inclined surface 45*b* of the rib 44*b* sufficiently across the surfaces thereof that the upward urging force on the member 6 is smoothly converted into a rotational force. Then, as illustrated in FIG. 8D, the sloped protrusion 63 enters the deep groove 43*b* and the cap 3 enters the released state.

OTHER EMBODIMENTS

In the container 1 according to the above-described embodiment, the position of the top surface of the push-button plunger 5 in the attached state and the released state of the cap 3 can be changed as appropriate. For example, the top surface of the push-button plunger may be made flush with the top surface of the housing in either the attached state or in the unlocked state.

Although in the container 1 according to the above-described embodiment the ratchet 6 is rotated clockwise when viewed from above, alternatively the ratchet 6 may be configured to rotate counterclockwise.

Although the container 1 according to the above-described embodiment is provided with a rotation assist mechanism, the rotation assist mechanism may be omitted if the ratchet 6 can be sufficiently pressed downward with respect to the housing 4, such as when the downward stroke of the push-button plunger 5 can be secured.

The air in the space formed between the top surface 61 of the ratchet 6 and the top surface 82 of the inner lid 8 in which the spring 7 is contained is alternately compressed and expanded as the ratchet 6 moves up and down, possibly making it difficult for the ratchet 6 to move to the lower position when the space is in a state of positive pressure or for the ratchet 6 to return to the upper position when the space is in a state of negative pressure state. For this reason, externally communicable air-hole vents may be formed in the top surface 61 of the ratchet 6 and the top surface 51 of the push-button plunger 5 so that outside air moves in and out of the space as the push-button plunger 5 moves up and down, to enable the push-button plunger 5 and the ratchet 6 to move up and down smoothly.

In the container 1 according to the present embodiment, the locking portion is formed by the flange 25 of the container body 2 engaging the latches 81 of the inner lid 8. However, the locking portion may have any shape, such as an undercut, provided that it has a shape that engages the latches 81 and restricts the upward movement of the cap 3.

The number of grooves (43*a*, 43*b*) in the outer cam (the number of sliding protrusions 55), and the number of sloped protrusions 63, may be set as appropriate as long as the push-button plunger 5 and the ratchet 6 move up and down so as not to tilt from the axis 100. In a case in which the number of sloped protrusions 63 is two, when the width of the sloped protrusions 63 in the rotation direction 110 is narrow, sloped protrusions 63 are formed at both ends of the diameter of the cylindrical ratchet 6 and there is a possibility that the ratchet 6 wobbles around this axis. Therefore, if the number of sloped protrusions 63 is at least three, that is, the total number of grooves (43*a*, 43*b*) in the outer cam and the number of sliding protrusions 55 that slide along the grooves (43*a*, 43*b*) is at least six, then any tilting of the ratchet 6 with respect to the axis 100 will be reliably suppressed.

It is to be noted that, if the number of sloped protrusions 63 and grooves (43*a*, 43*b*) is small, then the rotation angle of the ratchet 6 for a single vertical movement is large and the slope of the sloped surfaces (45*a*, 45*b*) of the ribs (44*a*, 44) becomes more moderate if the vertical height of the housing 4 is constant, possibly degrading the efficiency with which the upward urging force is converted into rotational movement. In any case, the numbers of sloped protrusions 63 and grooves (43*a*, 43*b*) may be set as appropriate in consideration of the diameter and the vertical height of the housing 4, the stability of the attachment/detachment operation of the cap 3, and the like.

The structure that presses the tab 87 formed on the inner lid 8 radially inward with the inner circumferential surface 67 of the ratchet 6 is not limited to the bent part 89. Thus, for example, a protrusion protruding radially outward may be formed on the tab 87, and that protrusion is pressed radially inward by the inner circumferential surface 67 of the ratchet 6, the tab 87 elastically deforms, and the latches 81 project inward from the inner circumferential surface 88 of the inner lid 8. In any case, it is sufficient if the tab 87 is formed with a portion that contacts the inner circumferential surface 67 of the ratchet 6 and is pressed radially inward.

Although in the above-described embodiment the tab 87 is stood vertically top to bottom along the peripheral wall 92 of the inner lid 8, the tab 87 may be formed so as to stand from the bottom to the top. Alternatively, it may be formed so as to extend circumferentially along the peripheral wall 92 of the inner lid 8.

The spring 7 is not limited to a coil spring and may instead be a spring of another form, such as a leaf spring. Further, the material of the spring 7 is not limited to metal and may be resin or the like. Further, instead of the spring 7, for example, an elastic resin or the like may be inserted between the inner lid 8 and the ratchet 6. In any case, it is sufficient if an elastic member urging the ratchet 6 upward is inserted between the inner lid 8 and the ratchet 6.

When the cap 3 is attached to the container body 2, the container 1 according to the above-described embodiment is configured so that the container body 2 and the cap 3 are coaxial with the axis 100. However, provided that the neck 23 has a cylindrical shape, the neck 23 may be formed so as to project in any appropriate direction such as at an angle to the container body 2. In that case, the axis 100 of the cap 3 attached to the neck 23 may be the vertical direction.

Further, the shape of the body portion 22 of the container body 2 is not limited to a cylinder and may instead be a shape such as a square cylinder. Similarly, the external shape of the housing 4 of the cap 3 is not limited to a cylinder. It is sufficient if the housing 4 forms a hollow cylinder with both upper and lower end faces open.

In the container 1 according to the above-described embodiment, the container body 2, the housing 4, the push-button plunger 5, the ratchet 6, and the inner lid 8 are made of molded resin. Alternatively, any or all of these members (2, 4, 5, 6, 8) are not limited to resin and may instead be made of a material such as metal.

Although the protrusion (55, 90) and the grooves (43*a*, 43*b*) of the guide protrusions 55, the rotation assist protrusions 65 and the release assist protrusions 90 that constitute the knock cam mechanism and release assist mechanism are formed continuously about the axis 100, alternatively these may be formed discontinuously at discrete intervals like the sloped protrusion 63. Thus, for example, by forming discontinuously one of two or more parts that interact with each other, such as the guide protrusions 55 and the sloped protrusion 63, friction may be reduced and operability improved. In addition, in the above-described embodiment, the shallow grooves 43*a* and the deep grooves 43*b* have the same pitch and the same period in the circumferential direction, the widths of the two types of ribs (44*a*, 44*b*) in the circumferential direction may be different if each of the shallow grooves 43*a* and the deep grooves are formed at the same pitch. It is sufficient then if the sliding protrusions 55 are formed corresponding to these grooves (43*a*, 43*b*), and the sloped protrusions 63 are formed at equiangular intervals where the shallow grooves 43*a* and the deep grooves 43*b* are formed in the attached state and the released state. The ratchet 6 then moves up and down without tilting with respect to the axis 100 in the attached state and the released state. Tabs 87 having latches 81 formed at the tips thereof are formed at equiangular intervals around the axis 100 in the peripheral wall 92 of the inner lid 8 that slides along the inner circumferential surface 67 of the rotating member 6, so the latches 81 project and retract evenly in the radial direction. In any case, the number and shapes of the various protrusions (53, 55, 63, 65, 90) and grooves (43*a*, 43*b*) that constitute the knock cam mechanism and the release assist mechanism may be formed taking into consideration the operability of each mechanism, ease of formation, manufacturing cost, and the like.

LIST OF REFERENCE NUMBERS

1 Container with cap
2 Container body
3 Cap
4 Housing
5 Push-button plunger
6 Ratchet
7 Spring (elastic body)
8 Inner lid
9 Packing
22 Body
23 Neck
25 Flange of neck
41 Top surface of housing
42 Inner surface of housing
43*a*, 43*b* Grooves
44*a*, 44*b* Ribs
45*a*, 45*b*, Rib sloped surfaces
51 Top surface of push-button plunger
52 Outer circumferential surface of push-button plunger
53 Sliding protrusion
55 Guide protrusion
56 Lower surface of guide protrusion
57 Inner circumferential surface of push-button plunger
61 Top surface of ratchet
62 Outer circumferential surface of ratchet
63 Sloped protrusion
64 Top surface of sloped protrusion
65 Rotation assist protrusion
66 Sloped surface of rotation assist protrusion
81 Latches
82 Top surface of inner lid
83 Lip of top surface of inner lid
84 Flange of inner lid
85 Outer circumferential surface of inner lid
87 Tab
88 Inner circumferential surface of inner lid
89 Bent part
90 Release assist protrusion
91 Release assist protrusion sloped surface
92 Side of inner lid (peripheral wall)
100 Cylindrical axis (axis)
110 Direction of rotation

What is claimed is:

1. A container with cap comprising:

a container body having a cylindrical neck; and a cap detachably attached to the neck, wherein the cap includes a hollow cylindrical housing whose end faces are open, a push-button plunger, a ratchet, and an inner lid, each disposed coaxially within the housing and each having a cylindrical shape with a closed top surface at one end and an opening at another end, and an elastic member inserted between the ratchet and the inner lid, urging the ratchet upward, wherein the housing has a plurality of grooves formed in an inner circumferential surface of the housing about a cylindrical axis of the housing, the grooves having a length extending in a vertical direction and a depth extending in a radially outward direction, each of the plurality of grooves formed in the inner circumferential surface of the housing has a closed upper end and an open lower end, with deep grooves and shallow grooves formed cyclically about the cylindrical axis and alternating with ribs interposed therebetween, a lower end surface of each of the ribs is a sloped surface sloped from bottom to top in a predetermined circumferential direction around the cylindrical axis of the housing defined as a rotation direction, the sloped surface being continuous with a lower end of a shallow groove adjacent to the rib in the rotation direction, the push-button plunger has a top surface that is exposed from an opening in the top end of the housing, with sliding protrusions formed around the outer circumferential surface of the push-button plunger that slide up and down in the vertical direction inside each of the plurality of grooves formed in the inner circumferential surface of the housing and triangular guide protrusions having downward-facing apexes at the bottom formed around the lower end of the push-button plunger about the cylindrical axis, the ratchet has a plurality of radially outwardly projecting sloped protrusions formed in the outer circumferential surface of the ratchet at equiangular intervals around the cylindrical axis, with an upper surface of each of the protrusions having a sloped surface that inclines from boom to top in the rotation direction, the inner lid is fixed to the housing, and a plurality of tabs are formed on the peripheral wall portion forming the side surface at equiangular intervals around the cylindrical axis, and at the tip of each of the plurality of tabs a latch is formed that protrudes radially inward, and the plurality of tabs uses stress directed from radially outward to radially inward to elastically deform the latches and project them toward the inner circumferential surface of the inner lid, wherein the elastic member urges the ratchet upward, and the container body is provided with a locking portion on the outer circumferential surface of the neck that engages the latches, wherein, when the ratchet is pushed down with a downward pushing action exerted on the push-button plunger, after the upper ends of the sloped protrusions positioned at the grooves reach the lower end position of the ribs, the ratchet is guided by the sloped surface of the ribs and rotates in the direction of rotation until it reaches the position of the adjacent groove, the ratchet switches alternately between an upper position when the sloped protrusion is in the deep groove position and a lower position when the sloped protrusion is in the shallow groove position, and wherein, when the ratchet is in the lower position, the tabs are pushed radially inward by the inner circumferential surface of the ratchet and the latches of the inner lid surrounding the neck engage the locking portion, and when the ratchet is in the upper position, engagement of the latches and the locking portion is released.

2. The container with cap according to claim 1, wherein the ratchet has rotation assist protrusions with downward-facing apexes formed along the lower end thereof around the cylindrical axis at a predetermined pitch, the inner lid is provided with a flange around the lower end, with release assist protrusions with upward-facing apexes formed on the upper surface of the flange around the cylindrical axis at the same predetermined pitch, the rotation assist protrusions and the release assist protrusions are parallel to each other, are tilted with respect to the rotation direction, have upper surfaces that slope in opposite directions vertically with respect to the rotation direction, and are out of phase in the vertical direction, and when the push-button plunger is pushed in from a state in which the latches engage the locking portion, the rotation assist protrusions are guided by the slope of the release assist protrusions and the ratchet rotates in the rotation direction.

3. The container with cap according to claim 1, wherein air-hole vents that communicate with outside to allow exchange of air are formed in both the top surface of the ratchet and the top surface of the push-button plunger.

4. The container with cap according to claim 1, wherein the container with cap has three or more of the sloped protrusions.

5. The container with cap according to claim 1, wherein the elastic member inserted between the inner lid and the ratchet and urging the ratchet upward is a coil spring.

6. The container with cap according to claim 1, wherein the top surface of the push-button plunger is flush with the top surface of the housing in one of an attached state of the cap or a detached state of the cap.

7. The container with cap according to claim 1, wherein the container body, the housing, the push-button plunger, the ratchet, and the inner lid are made of molded resin.

8. The container with cap according to claim 1, wherein the neck connects to the container body at an angle to the cylindrical axis of the container body.

* * * * *